United States Patent [19]

Sturges

[11] Patent Number: 4,838,805

[45] Date of Patent: Jun. 13, 1989

[54] CONNECTOR ENGAGING NUT LOCKING MECHANISM

[75] Inventor: James R. Sturges, Barrington, R.I.

[73] Assignee: Raytheon Company, Lexington, Mass.

[21] Appl. No.: 752,494

[22] Filed: Jul. 8, 1985

Related U.S. Application Data

[63] Continuation of Ser. No. 568,471, Jan. 5, 1984, abandoned.

[51] Int. Cl.[4] ..... H01R 4/38

[52] U.S. Cl. ..... 439/321; 439/586; 439/599

[58] Field of Search ..... 339/89 R, 89 C, 89 M, 339/90 R, 90 C, DIG. 2

[56] References Cited

U.S. PATENT DOCUMENTS

| | | | |
|---|---|---|---|
| 2,890,434 | 6/1959 | Ray et al. | 339/91 |
| 3,343,852 | 9/1967 | Blight et al. | 339/89 M |
| 3,462,727 | 8/1969 | Blight et al. | 339/89 M |
| 3,552,777 | 1/1971 | Heinrich | 285/81 |
| 3,808,580 | 4/1974 | Johnson | 339/89 R |
| 3,917,373 | 11/1975 | Peterson | 339/89 R |
| 4,462,653 | 7/1984 | Flederbach et al. | 339/89 R |

FOREIGN PATENT DOCUMENTS

| | | | |
|---|---|---|---|
| 1188157 | 9/1959 | France | 339/DIG. 2 |
| 825579 | 12/1959 | United Kingdom . | |

*Primary Examiner*—David Pirlot

*Attorney, Agent, or Firm*—Martin M. Santa; Richard M. Sharkansky

[57] ABSTRACT

A locking type of connector assembly consists of two connector halves, one half having a more compliant surface in pressure contact with a surface of the other half. The surfaces have mating protrusions and recesses which are in pressure contact. The torque required to misalign the mating surfaces after tightening the connector is sufficiently great to prevent loosening of the connector by vibration.

15 Claims, 5 Drawing Sheets

CONNECTOR ENGAGING NUT LOCKING MECHANISM

BACKGROUND OF THE INVENTION

This invention was made during the performance of a contract from the U.S. Department of the Navy, Contract No. N00024-78-C-6395.

This application is a continuation of application Ser. No. 568,471 filed Jan. 5, 1984, now abandoned.

This invention relates to a threaded-nut locking mechanism for connectors and more particularly to a locking mechanism which utilizes deformations of the most resilient portion of the connector for mating engaging connection with a less resilient portion of the connector to provide the locking function.

Conventional connector engaging nuts are frequently subjected to environmental and/or mechanical service conditions in which the engaging nut tends to back off or unscrew from the remainder of the connector thereby making the connector suseptible to unintentional disengagement. The service conditions referred to could be almost anything cyclic in nataure, the most well known probably being the presence of mechanical vibrations.

In the prior art, the locking nut is prevented from accidentally turning by a spring-loaded projection or ball provided on one portion of the connector which is engaged with indentations on the nut of the connector. Alternatively, the nut may be prevented from unintentionally turning by threading a wire through the nut and securing the wire to another part of the connector. These prior art techniques are either expensive, nonautomatically locking, awkward to use, or subject to operator misuse or abuse causing failure of the locking mechanism.

In view of the deficiencies of the prior art nut locking mechanisms, it is a primary object of this invention to provide a nut locking mechanism which is reliable, inexpensive, and automatically locking without using any additional elements over those used in similar connectors without the nut locking mechanism of this invention.

Also in the prior art, the function of locking an engaging nut is commonly performed by using set screws, Loctite applied to the threads, or lockwashers. Again, each of these locking systems are considered to be relatively expensive, requiring rework if the connector is disconnected and reconnected, relatively unreliable, and excessively demanding of space requirements because of accessibility considerations. Also, the prior art locking mechanisms may generate an excess of internal "noise" (from metal-to-metal contact) unacceptable for some applications involving sensitive instrumentation or requiring very low inherent noise generation.

It is a feature of this invention that it makes use of the compressibility of one of the bearing surfaces (or of a compressible washer if neither of the bearing surfaces of the connector is compressible) to provide as an object of the invention a positive locking mechanism which is very inexpensive, very reliable, with no extra space requirement for accessibility to the locking mechanism of the connector, with no requirement for reworking of the connector if reused, and a connector locking mechanism which generates extremely low self-noise levels.

SUMMARY OF THE INVENTION

A locking type of connector assembly consists of two connector halves, one half having a more compliant surface in pressure contact with a surface of the other half. The surfaces have mating protrusions and recesses which are in pressure contact. The torque required to misalign the mating surfaces after tightening the connector is sufficiently great to prevent loosening of the connector by vibration.

BRIEF DESCRIPTION OF THE DRAWINGS

The objects and features of this invention are explained in the following description taken in conjunction with the accompanying drawings in which.

DESCRIPTION OF THE PREFERRED EMBODIMENT

Figure 1A:
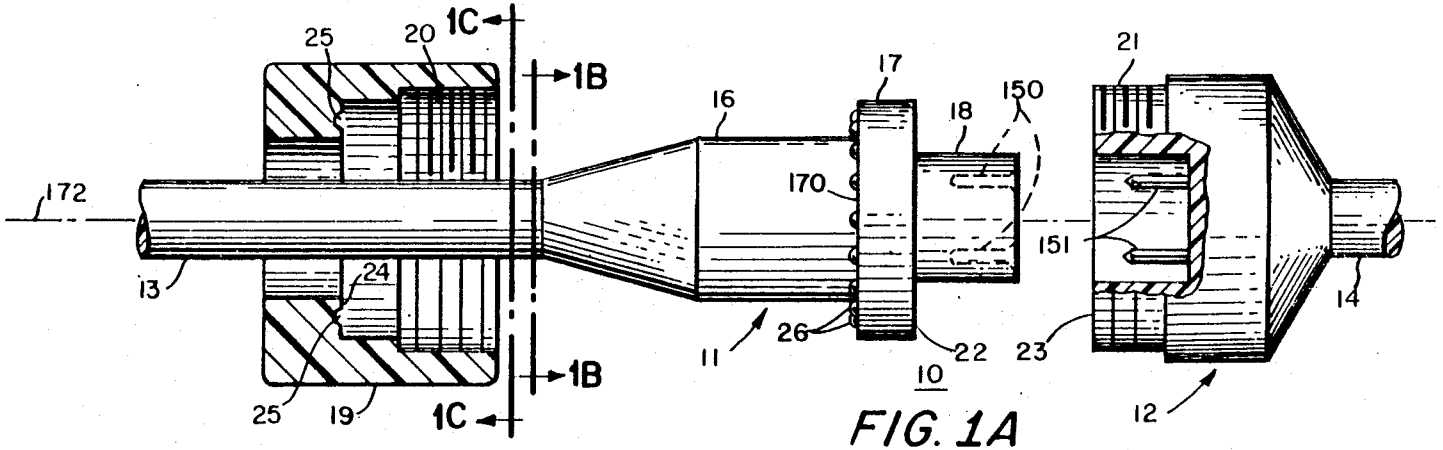
FIGS. 1A, 2A, 3A, 4A and 5A are exploded side views in partial cross-section of different embodiments of the connector assembly of this invention.

Referring to FIG. 1A, there is shown an exploded view in partial cross-section of a connector assembly 10 which consists of a male connector 11 and a female connector 12. The male and female connectors are typically electrical connectors which have mating terminals 150, 151 to which the wires (not shown) contained in the cables 13 and 14 are connected. The connector 11 has a body portion 16, a shoulder portion 17 and a terminal containing portion 18. The portions 16, 17, 18 are preferably molded to one substance to form a unitary connector 11. In this preferred embodiment, the material from which the connector 11 is molded is a compliant material such as an elastomer whereas the connecting nut 19 and connector 12 are preferably made of a stiff plastic or a less compliant elastomer. Engaging nut 19 on connector 11 and connector 12 have threaded portions 20, 21, respectively. Tightening nut 19 to connector 12 brings the face 22 of shoulder 17 into contact with the face 23 of connector 12, and the face 170 of shoulder 17 in contact with face 24 of nut 19. In order to prevent the nut from backing off the threads 21 of connector 12 and self-loosening because of environmental or operating conditions, especially vibration, the nut 19 and connector 11 have been modified in accordance with this invention.

Figure 1B:
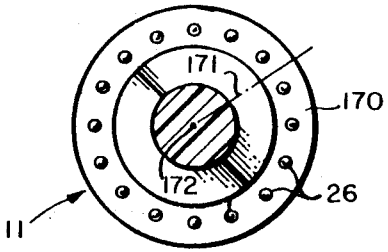
FIGS. 1B, 2C, 3C and 4C are cross-sectional views of the connector assembly taken along section line 1B of FIG. 1A; section line 2C of FIG. 2A; section line 3C of FIG. 3A; and section line 4C of FIG. 4A, respectively, showing the connector shoulder.
Figure 1C:
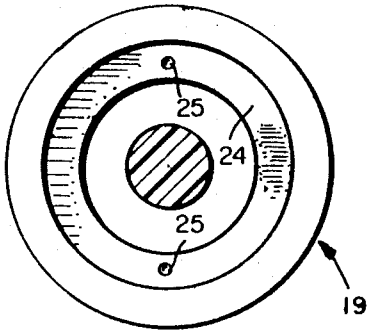
FIGS. 1C, 2B, 3B and 5B are cross-sectional end views of the engaging nut taken along section line 1C of FIG. 1A; section line 2B of FIG. 2A; section line 3B of FIG. 3A; and section line 5B of FIG. 5A, respectively.

The nut locking mechanism of this preferred embodiment comprises a plurality of protrusions 26 formed or molded into the face 170 of shoulder 17 are shown in FIG. 1A and the end view 1B of connector 11 of FIG. 1B. The protrusions 26 are partial spheres protruding from the surface 170 of shoulder 17. The protrusions are uniformly angularly distributed at a radius 171 from axis 172. The engaging nut 19 of the locking mechanism has a shoulder surface 24 which is in sliding contact with the surface 170 of shoulder 17. The surface 24 of nut 19 has a plurality of depressions or recesses 25 which the projections 26 of connector 11 fit. Preferably, the projections and recesses are the same size and shape. FIG. 1C shows an end view of engaging nut 19 which illustrates the spherical recessions 25 into which the spherical projections 26 fit. In FIG. 1C, the engaging nut 19 is shown with only two recesses 25 diagonally opposite one another. As the nut 19 is tightened on connector half 12, the pair of recesses 25 will move from one pair of opposite projections 26 to an angularly adjacent pair, being filled when in alignment with each pair of projections. The remaining projections 26 are compressed by the flat surface 24 of nut 19. Thus, the locking mechanism operates by having protrusions 26 expand into mating recesses 25 when they are aligned. When aligned, more torque in either direction, clockwise or counterclockwise, is required to turn the nut 19 in order to misalign the mated projections 26 and depressions 25. As the engaging nut 19 is tightened to mate the connectors 11, 12, it requires more torque to misalign a mated set of protrusions and recesses.

Although the engaging nut is shown with two recesses 15, it is apparent that greater force would be required to dislodge protrusions 26 when the nut has a greater number of recesses 25 which simultaneously engage the protrusions 26. Thus, the engaging nut 19 may have as few as one recess 25 and as many recesses as there are protrusions 21 on the connector half 11. The angular spacing of the recesses 25 is an integer multiple of the equal angular spacing of the protrusions 26. The number of protrusions 26 is determined by the desired minimum angular rotation of the engaging nut between its "locked" positions where the protrusions 26 and the recesses 25 are in alignment. The difference between the torque required to move the engaging nut when it is in its "locked" position relative to the torque required to move the engaging nut between these locked positions is greatest when the number of protrusions 26 is equal to the number of recesses 25.

Figure 2A:
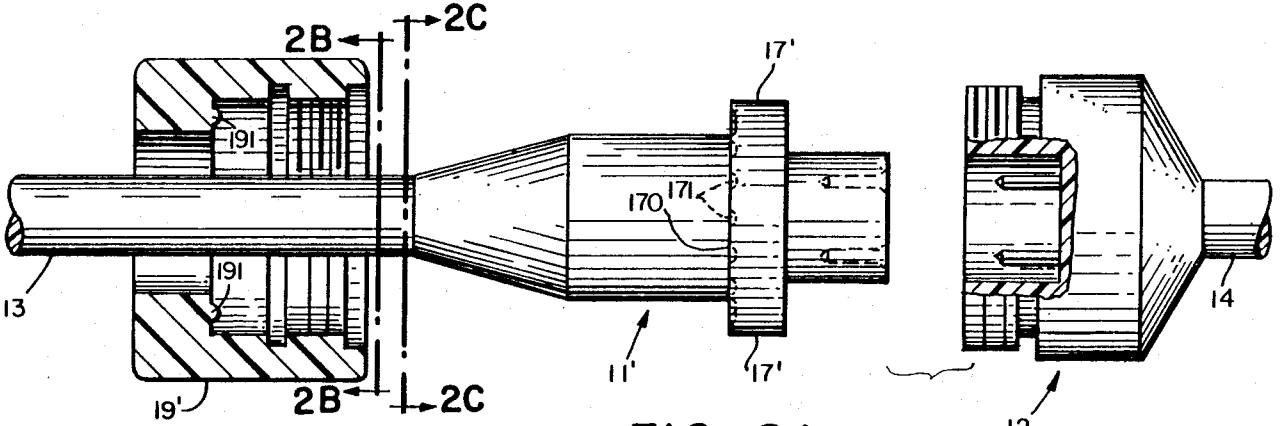

An alternate embodiment of the invention is shown in the exploded partial cross-sectional view of FIG. 2A where the engaging nut 19' has protrusions 191 instead of recesses 25 and the connector half 11' shoulder 17' has a plurality of recesses 171 instead of protrusions 26 as in FIG. 1A. The engaging nut 19' is made of less resilient material than the shoulder 17' which allows the protrusions 191 of nut 19' to depress the face 170 of shoulder 17' in those angular positions of nut 19 where the protrusion 191 is not contained within the recesses 171.

Figure 2C:
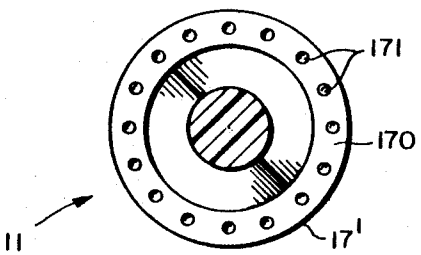
Figure 2B:
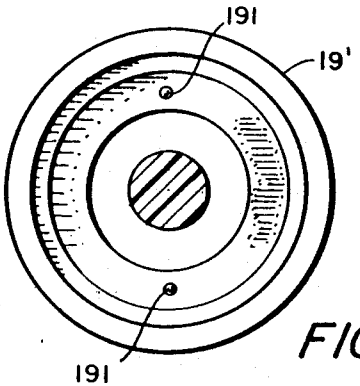

The end view 2B of nut 19' is shown in FIG. 2B and the end view 2C of connector 11' is shown in FIG. 2C. The configuration of FIG. 2A has an advantage over that of FIG. 1A since there are only two protrusions 191 depressing the softer shoulder 170 in the region between alignment portions of the protrusions 191 and recesses 171, thereby increasing the ratio of the "locked" torque to the torque required to turn the nut between alignment positions. It is seen that the plurality of recesses 171 produces many "locking" positions for nut 19'. It is also apparent that nut 19' may have as little as one protrusion 191 or as many protrusions as there are recesses in shoulder 17'.

Figure 3A:
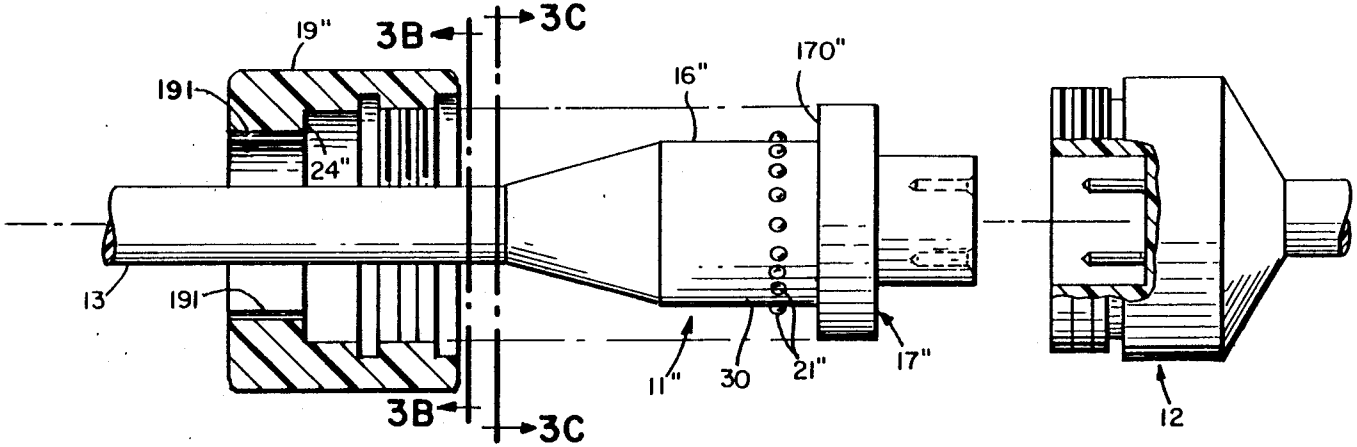
Figure 3C:
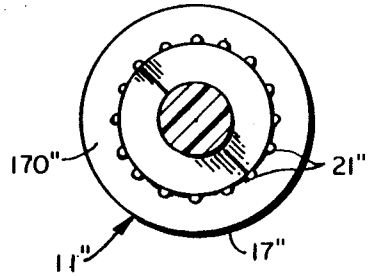
Figure 3B:
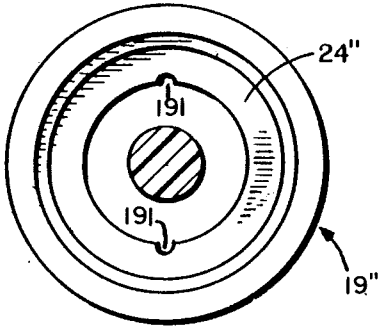

A third embodiment of the invention is shown in the exploded partially cross-sectional view of FIG. 3A where the connector assembly shows the connector 11'' with a plurality of protrusions 21'' which are equally angularly distributed along the circumference of body 16'' of the connector 11''. The engaging nut 19'' is shown with longitudinal grooves or recesses 191 which engage the protrusions 21'' at selected angular positions of the engaging nut 19''. The protrusions 21'' are molded integrally with the body 16''. The shoulder 17'', protrusions 21'' and body 16'' of the connector 11'' are of a more compliant material than the engaging nut 19''. As with FIG. 2, the nut 19'' could be constructed with protrusions instead of recesses 191 for mating with corresponding recesses instead of the protrusions 21''. The embodiment of FIG. 3A differs from that of the embodiments of FIGS. 1A and 2A in that the amount of force required to overcome the "locking" of protrusions 21'' and recesses 191 is the same whether or not the nut 19'' is tightly turned against the half connector 12 or is only loosely on it, the torque required to turn said nut being greater when mating of the protrusions and recesses occurs. FIGS. 3B and 3C show end views 3B, 3C, respectively, of the engaging nut 19'' and the connector half 11''.

Figure 4A:
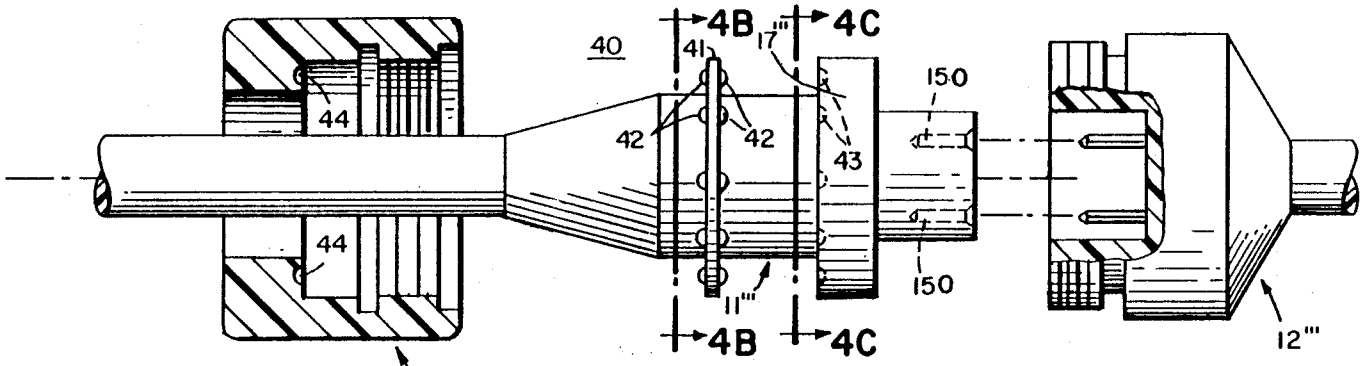
Figure 4C:
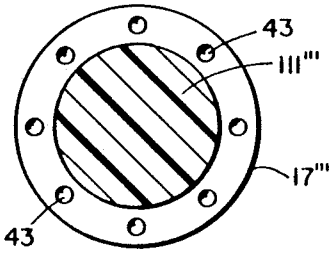
Figure 4B:
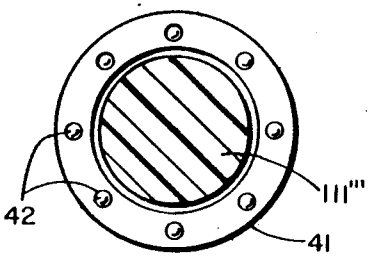
FIG. 4B is an end view of the engaging washer of FIG. 4A taken along section line 4B.

Another embodiment of the invention is shown in the exploded, partial cross-sectional view of FIG. 4A where a connector assembly 40 is shown as combining connectors 11''', 12''', engaging nut 19''' and a compliant washer 41. The washer 41 is more compliant than either connector 11''' or nut 19''' and has a plurality of protrusions 42 on each side which mate with an equal or greater number of recesses 43, 44 on the connector 11''' and nut 19''', respectively, to provide the "locking" condition. This embodiment is similar to the embodiments of FIGS. 1 and 2 except that it allows both the connector 12''' and nut 19''' to be made of the same material which may be very noncompliant if desired because the washer 41 provides the necessary compliance. A greater number of protrusions 42 on one side of washer 41 (and a corresponding number or greater of recesses 43, 44) will result in the washer 41 locking on the side having the greater number of protrusions prior to locking on the other side. As with the preferred described embodiments, the washer may be made with recesses instead of protrusions with corresponding changes of the recesses to protrusions on connector 11''' and nut 19'''. FIGS. 4B and 4C show end views of the connector 11''' and washer 41, respectively, with the recesses 44 of nut 19''' corresponding in number to the protrusions 42 of connector 11'''.

Figure 5A:
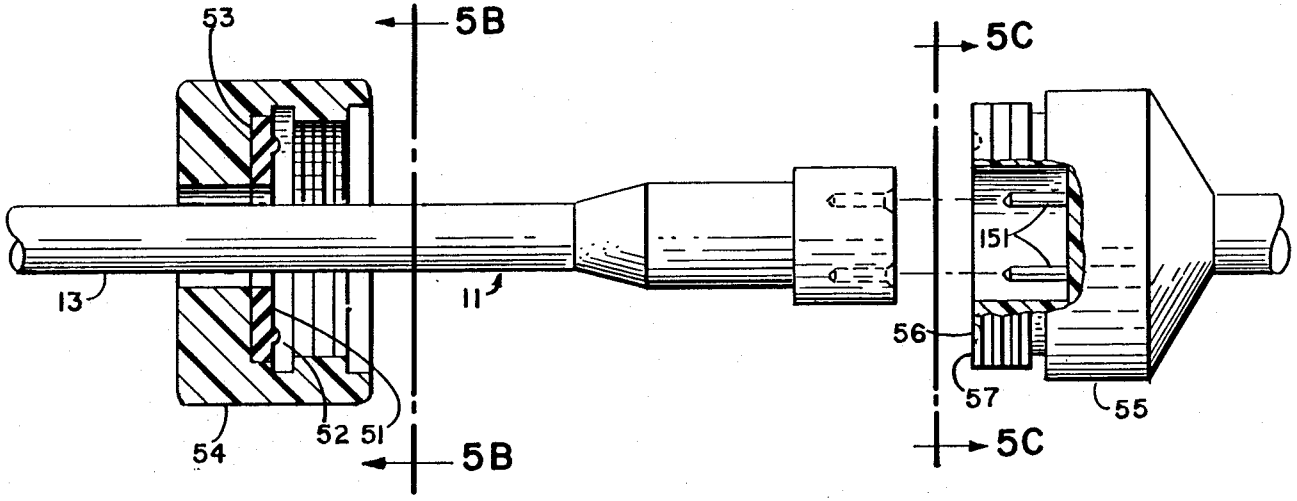

FIG. 5A shows another alternative embodiment of the invention which uses a compliant washer 51 which is bonded to the bearing surface 53 of the less compliant engaging nut 54. The connector 55 has recesses 56 which are angularly spaced at a constant radius on the bearing surface 57 with which the compliant washer 51 makes contact. The connector 55 and the engaging nut 54 are of less compliant material such as plastic. In the embodiment of FIG. 5A, the connector 11 need not be of a compliant material since the compliance is provided by the washer 51.

Figure 5C:
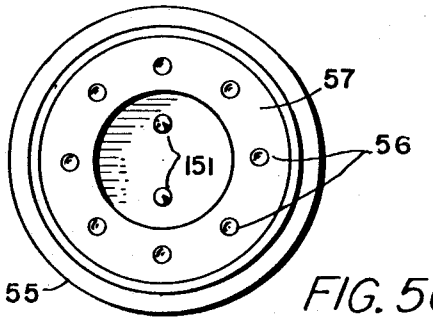
FIG. 5C is an end view of the connector of FIG. 5A taken along section line 5C.
Figure 5B:
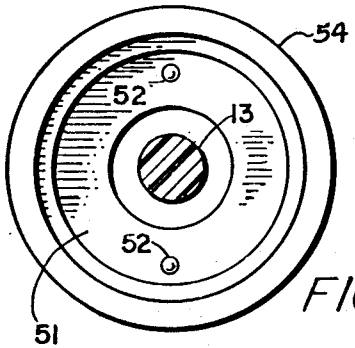

FIG. 5B shows an end view of nut 54 and washer 51. Washer 51 is shown with two protrusions 52. FIG. 5C shows that connector 55 has more than two recesses 56 into which the protrusions 52 may be aligned for "locking". The operation of the locking mechanism of this embodiment illustrates that the protrusions may be more compliant than the recesses in contact with the embodiment of FIG. 2A where the reverse is true. Alternatively, washer 51 could have a plurality of recesses instead of protrusions and recesses 56 could be one or more protrusions.

It will be apparent to those skilled in the art that although the invention has been described in terms of partially spherical protrusions and spherical recesses that other forms of recesses and protrusions are available. As an example, in FIG. 1A, the protrusions and recesses instead of being spherical could be radially directed, partially cylindrical grooves and ridges, respectively. Alternatively, for the embodiment of FIG. 3A, the partially spherical protrusions 21'' could be longitudinal partially cylindrical protrusions which would fit into the longitudinal grooves 191 of the engaging nut 19''. It will also be apparent that in these various embodiments, protrusions may be substituted for recesses and vice versa with the consideration that the recesses not be equal to or exceed the number of protrusions. Also, whether the protrusion (or recess) is in the more or less compliable material is a matter of choice with no substantial different in "locking" capability.

Having described a preferred embodiment of the invention, will now be apparent to one of skill in the art that other embodiments incorporating its concept may be used. It is felt, therefore, that this invention should not be limited to the disclosed embodiment, but rather should be limited only by the spirit and scope of the appended claims.

What is claimed is:

1. A connector assembly comprising:
a male and female connector;
one connector having a threaded end portion;
the other connector having a body, a radially outwardly projecting shoulder which is unitary with said body and a threaded connecting nut;
said other connector shoulder being an elastomer which is more compliant than said end portion and said nut;
said connecting nut threadedly engaged with said one connector;
said connecting nut being a substantially stiff plastic non-compliant material and having an inwardly projecting shoulder which is less compliant than said other connector shoulder and which has a surface transverse to the axis of said connecting nut;
said other connector shoulder having a surface transverse to the axis of said connecting nut; and
said surfaces being in sliding contact with each other, one of said contacting surfaces having at least one integral protrusion and the other of said surfaces having at least one recess, said other connector body and nut being of different materials.

2. A connector assembly comprising:
a first and second mating connector;
said first connector having a threaded portion;
said second connector being an elastomer and having a threaded engaging nut of stiff plastic rotatably connected by said threads to said first connector;
said second connector and said nut having mating protrusions and recesses which are in alignment at predetermined angular positions;
the torque on said nut required to rotate said connector nut with respect to said second connector being greater when said protrusions and recesses are in alignment than when not in alignment; and
said protrusions and recesses are formed of materials having different compliances.

3. A connector assembly comprising:
a first and second mating connector having a common longitudinal axis;
connector engaging means having a surface transverse to said axis;
an elastomeric washer having a first surface facing a surface of said first connector and a second surface facing said surface of said connector engaging means;
said washer being between said first connector surface and said surface of said connector engaging means;
said washer surfaces being substantially planar with nonplanar regions;
said washer having said first surface congruent with a surface of said first connector and having said second surface congruent with said surface of said connector engaging means; and
said connector engaging means compressing said washer between said surface and said first connector surface and holding said congruent surfaces in pressure contact.

4. The connector assembly of claim 3 wherein:
said washer surfaces are of a different compliance from said surfaces of said first and second connectors.

5. The connector assembly of claim 3 wherein:
said washer is a more compliant material than said first and second connectors.

6. The connector assembly of claim 3 wherein:
said connector engaging means comprises an engaging nut on said first connector, said nut being threadedly connected to said second connector to force said surfaces against said washer surfaces when said nut is tightened.

7. A connector assembly comprising:
a first and second connector;
said first connector comprising an elastomer shoulder and an engaging nut of stiff plastic having contacting surfaces, said shoulder being of a more compliant material than said second connector and said nut;
said surfaces being substantially planar with non-planar regions, said surfaces being congruent surfaces;
said engaging nut and said second connector having engaged threaded portions by which said congruent contacting surfaces are tightened against each other.

8. The connector assembly of claim 7 in which:
one of said contacting surfaces has at least one protrusion; and
the other of said contacting surfaces has a plurality of recesses which mate with said protrusion at a plurality of angular positions of said nut with respect to said shoulder.

9. The connector assembly of claim 8 wherein:
the number of protrusions is equal to the number of recesses.

10. The connector assembly of claim 8 wherein:
the protrusions and recesses are partially spherical shapes in which the protrusions mate with said recesses.

11. The connector assembly of claim 7 in which:
one of said contacting surfaces has a plurality of protrusions angularly distributed over said one surface; and
the other of said contacting surfaces has at least one recess, said at least one recess mating with the protrusions at a plurality of angular positions of said nut with respect to said shoulder.

12. The connector assembly of claim 11 wherein:

the number of recesses is equal to the number of protrusions.

13. The connector assembly of claim 11 wherein:

the protrusions and recesses are partially spherical shapes in which the protrusions mate with said recesses.

14. A connector assembly comprising:

a first and second connector;

said first connector comprising a body and a threaded nut;

said body and said nut being of different materials and each having cylindrical surfaces which are in contact;

the cylindrical surface of said body being of more compliant elastomer material than said nut and its cylindrical surface;

one of said cylindrical surfaces having at least one protrusion and the other of said cylindrical surfaces having at least one recess which mate at preselected relative rotational positions of said nut and said body, the torque required to turn said nut being greater when said mating occurs than when not mated;

said second connector having a threaded portion which is engaged by said threaded nut to cause said first and second connectors to connect to each other.

15. The connector assembly of claim 14 in which:

said body portion cylindrical surface has a plurality of protrusions; and said nut has at least one recess which mates with said protrusions at preselected angular positions of said nut on said body portion.

* * * * *